US007183981B1

(12) United States Patent
Chao

(10) Patent No.: US 7,183,981 B1
(45) Date of Patent: Feb. 27, 2007

(54) MONOPOLE ANTENNA

(75) Inventor: Wen-Shin Chao, Taichung (TW)

(73) Assignee: Arcadyan Technology Corporation, Hsinchu (TW)

( * ) Notice: Subject to any disclaimer, the term of this patent is extended or adjusted under 35 U.S.C. 154(b) by 36 days.

(21) Appl. No.: 11/217,372

(22) Filed: Sep. 2, 2005

(51) Int. Cl.
*H01Q 1/38* (2006.01)

(52) U.S. Cl. ..... 343/700 MS; 343/846

(58) Field of Classification Search ..... 343/700 MS, 343/702, 829, 846
See application file for complete search history.

(56) References Cited

U.S. PATENT DOCUMENTS 4,864,320 A * 9/1989 Munson et al. ..... 343/833
5,550,554 A * 8/1996 Erkocevic ..... 343/828
5,668,560 A * 9/1997 Evans et al. ..... 343/702
6,100,850 A * 8/2000 Utsumi ..... 343/702
7,126,544 B2 * 10/2006 Liu et al. ..... 343/700 MS
2003/0189522 A1 * 10/2003 Zailinger ..... 343/702

* cited by examiner

*Primary Examiner*—Tho Phan
(74) *Attorney, Agent, or Firm*—Rosenberg, Klein & Lee

(57) ABSTRACT

A monopole antenna is disclosed. The monopole antenna comprises a base board, a first substantially L-shaped conductor, a first ground plane, a second substantially L-shaped conductor, a second ground plane and a feeding strip, and the monopole antenna further has a plurality of evenly-distributed through holes penetrating the base board from the first substantially L-shaped conductor to the second substantially L-shaped conductor. When the monopole antenna is operated at about 2.4–2.5 GHz, good radiation patterns and antenna gain are obtained for being applicable to IEEE802.11b/g specifications.

20 Claims, 8 Drawing Sheets

MONOPOLE ANTENNA

FIELD OF THE INVENTION

The present invention relates to a monopole antenna, and more particularly, to the monopole antenna with capacitance loaded.

BACKGROUND OF THE INVENTION

With the advancement of communication technologies, the applications using communication technologies have also increased significantly, thus making the related products more diversified. Especially, consumers have more demands on advanced functions from communication applications, so that many communication applications with different designs and functions have been continuously appearing in the market, wherein the computer network products with wireless communication functions are the main streams recently. Moreover, with integrated circuit (IC) technologies getting matured, the size of product has been gradually developed toward smallness, thinness, shortness and lightness.

An antenna in the communication products is an element mainly used for radiating or receiving signals, and the antennas used in the current wireless products have to own the features of small size, excellent performance and low cost, so as to be broadly accepted and confirmed by the market. Generally, the features of antenna can be known by the parameters of operation frequency, radiation pattern, return loss, and antenna gain, etc. With regard to a common wireless apparatus, such as an access point (AP), a dipole antenna is generally used therein, and is formed on a printed circuit board (PCB) for data communication. Since the common dipole antenna has a longer size, it occupies more space on the printed circuit board, and also the cost for fabricating such an antenna is relatively higher. The monopole antenna is one of the simplest antennas in structure, and thus is suitable for use in a wireless apparatus requiring small size. For example, in a USB wireless card, the size of the antenna has to be small for fitting.

Reduction of the monopole antenna's physical size reduces the operating radiation bandwidth of the antenna. In order to overcome this problem caused from size reduction, several conventional monopole antennas having such as helical radiating elements and a sleeve surrounding the monopole radiating element, etc. have been provided. However, it has been difficult to manufacture these conventional antennas within strict tolerance requirements. Moreover, even though these conventional antennas may reduce the antenna's physical length, they still have the adverse effect of inherently increasing the diameters thereof, thus actually increasing the antenna's overall size.

Moreover, it is quite difficult for the conventional monopole antennas to simultaneously have the feature of low cost, small size, high antenna gain, broad operation bandwidth and good radiation patterns, so that the applications of the conventional monopole antennas are greatly limited.

Hence, there is an urgent need to develop a monopole antenna for satisfactorily meeting the antenna requirements of low cost, small size, high antenna gain, broad operation bandwidth and good radiation patterns, thereby overcoming the disadvantages of the conventional monopole antenna.

SUMMARY OF THE INVENTION

In an aspect of the present invention, a monopole antenna is provided for meeting the requirements of low cost, small size, high antenna gain, broad operation bandwidth and good radiation patterns.

In the other aspect of the present invention, a monopole antenna is provided for generating excellent capacitance and inductance effects.

In accordance with the aforementioned aspect of the present invention, the present invention provides a monopole antenna. According to a preferred embodiment of the present invention, the monopole antenna comprises a base board, a first substantially L-shaped conductor, a first ground plane, a second substantially L-shaped conductor, a second ground plane and a feeding strip. The base board has a first planar surface and a second planar surface opposite to the first planar surface. The first substantially L-shaped conductor is formed on the first planar surface, wherein the first substantially L-shaped conductor is composed of a first main radiating strip and a first extension radiating strip connecting to the first main radiating strip, wherein a first rounded angle is formed between the first main radiating strip and the first extension radiating strip. The first ground plane is formed on the first planar surface, wherein the first main radiating strip and the first ground plane are parallel to and spaced from each other by a predetermined distance. The second substantially L-shaped conductor is formed on the second planar surface, wherein the second substantially L-shaped conductor is composed of a second main radiating strip and a second extension radiating strip connecting to the second main radiating strip, and a second rounded angle is formed between the second main radiating strip and the second extension radiating strip. The second ground plane formed on the second planar surface, wherein the second main radiating strip and the second ground plane are parallel to and spaced from each other by the aforementioned predetermined distance. A feeding strip is electrically connected to the open end of the first extension radiating strip. The monopole antenna of the present invention further has a plurality of through holes that penetrate the base board and are evenly distributed on the first substantially L-shaped conductor and the second substantially L-shaped conductor.

Hence, with the use of the present invention, the monopole antenna can meet the requirements of low cost, small size, high antenna gain, broad operation bandwidth and good radiation patterns, and also can generate excellent capacitance and inductance effects.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1A:
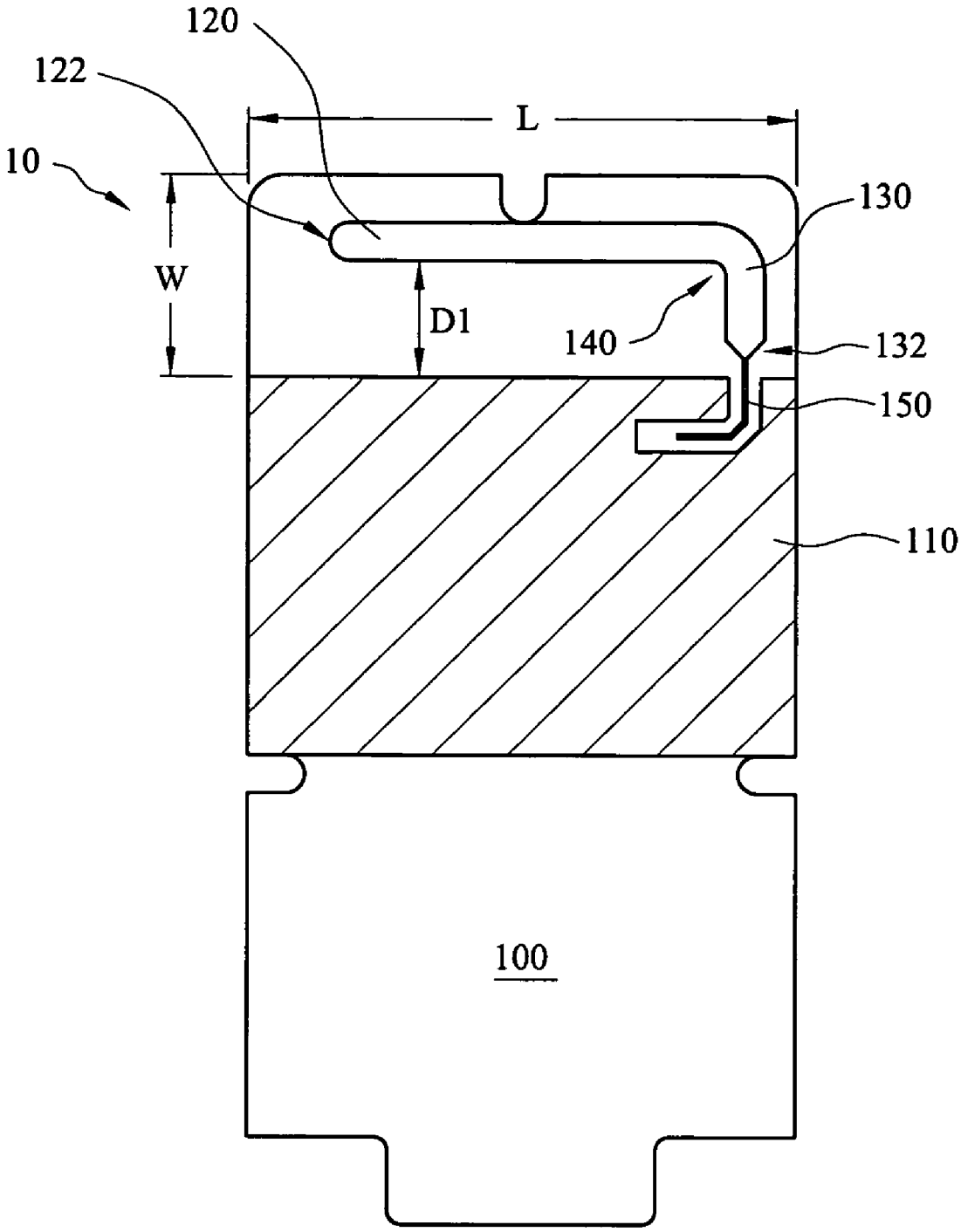
FIG. 1A is a schematic top view of a monopole antenna, according to a first preferred embodiment of the present invention.
Figure 1B:
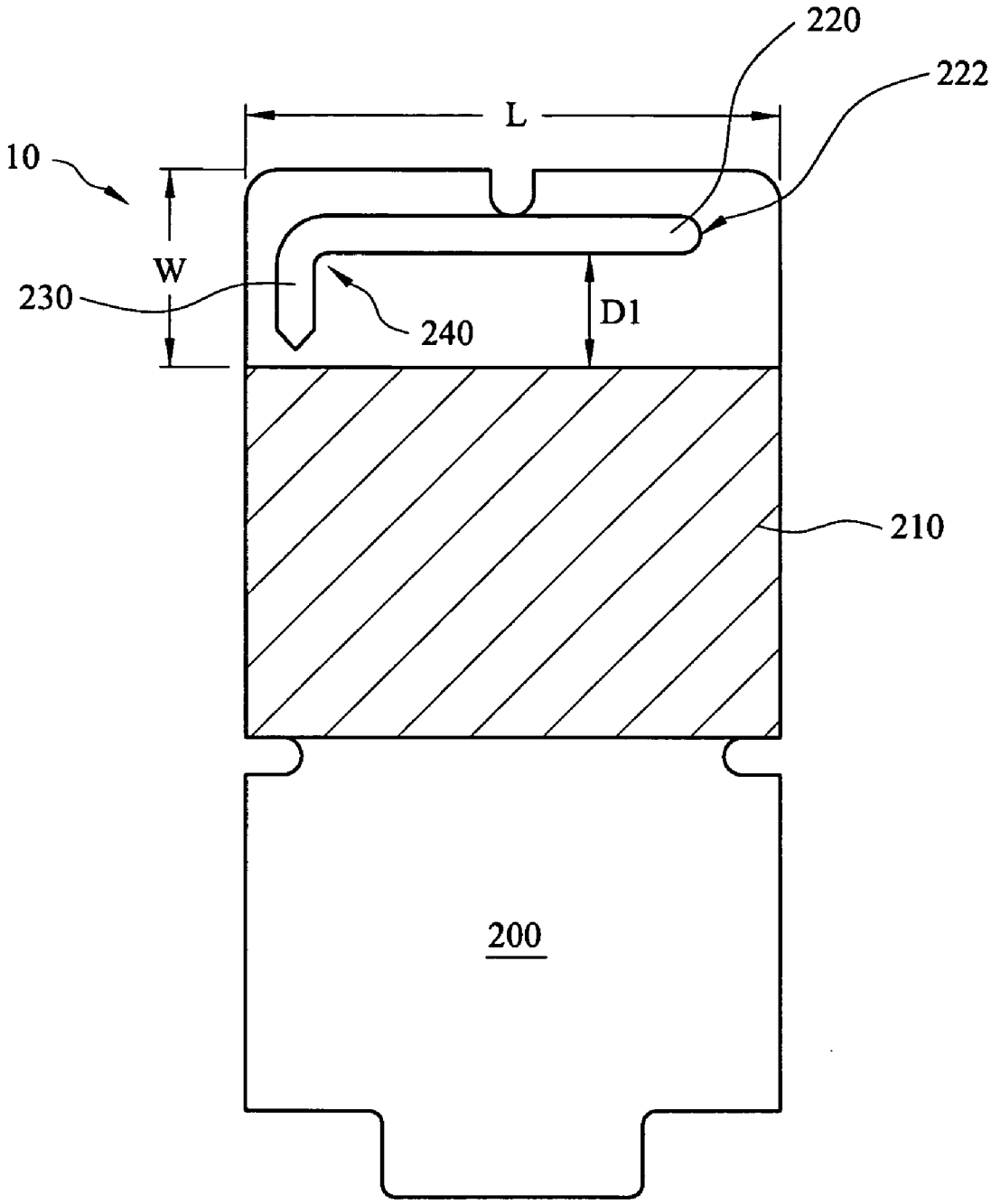
FIG. 1B is a schematic bottom view of the monopole antenna, according to the first preferred embodiment of the present invention.

Referring to FIGS. 1A and 1B, FIG. 1A and FIG. 1B are schematic top and views showing a monopole antenna according to a first preferred embodiment of the present invention. The monopole antenna of the present invention is basically composed of two substantially L-shaped conductors (first and second substantially L-shaped conductors; not labeled) respectively formed on two opposite surfaces (a first planar surface 100 and a second planar surface 200) of a base board 10, wherein the base board 10 can be such as a printed circuit board made of BT (bismaleimide-triazine) resin or FR4 fiberglass reinforced epoxy resin, and the first and second substantially L-shaped conductors can be mirror-reflected to each other.

The first substantially L-shaped conductor is formed on the first planar surface 100, and is composed of a first main radiating strip 120 and a first extension radiating strip 130. The first extension radiating strip 130 is perpendicularly connected to the first main radiating strip 120 with a first rounded angle 140. The first ground plane 110 is formed on the first planar surface 100, wherein the first main radiating strip 120 is parallel to the first ground plane 110, and the first main radiating strip 120 is spaced from the first ground plane 110 by a predetermined distance D1. The second substantially L-shaped conductor is formed on the second planar surface 200, wherein the second substantially L-shaped conductor is composed of a second main radiating strip 220 and a second extension radiating strip 230. The second extension radiating strip 230 is perpendicularly connected to the second main radiating strip 220 with a second rounded angle 240. The second ground plane 210 is formed on the second planar surface 200, wherein the second main radiating strip 220 is parallel to the second ground plane 230, and is spaced from the second ground plane 230 by the predetermined distance D1. The first main radiating strip 120 and the second main radiating strip 220 each can generate inductance effect, and capacitance effects can be generated between the first main radiating strip 120 and the first ground plane 110, and between the second main radiating strip 220 and the second ground plane 210, so that the monopole antenna of the present invention is a capacitance-loaded monopole antenna.

A feeding strip 150 (such as a 50Ω coaxial cable) is electrically connected to the open end of the first extension radiating strip. For the consideration of impedance match, the open end of the first extension radiating strip 130 is formed in such as a V shape, so is that of the second extension radiating strip 230. Moreover, the open end of the first main radiating strip 120 and that of the second main radiating strip 220 can be rounded.

Figure 2A:
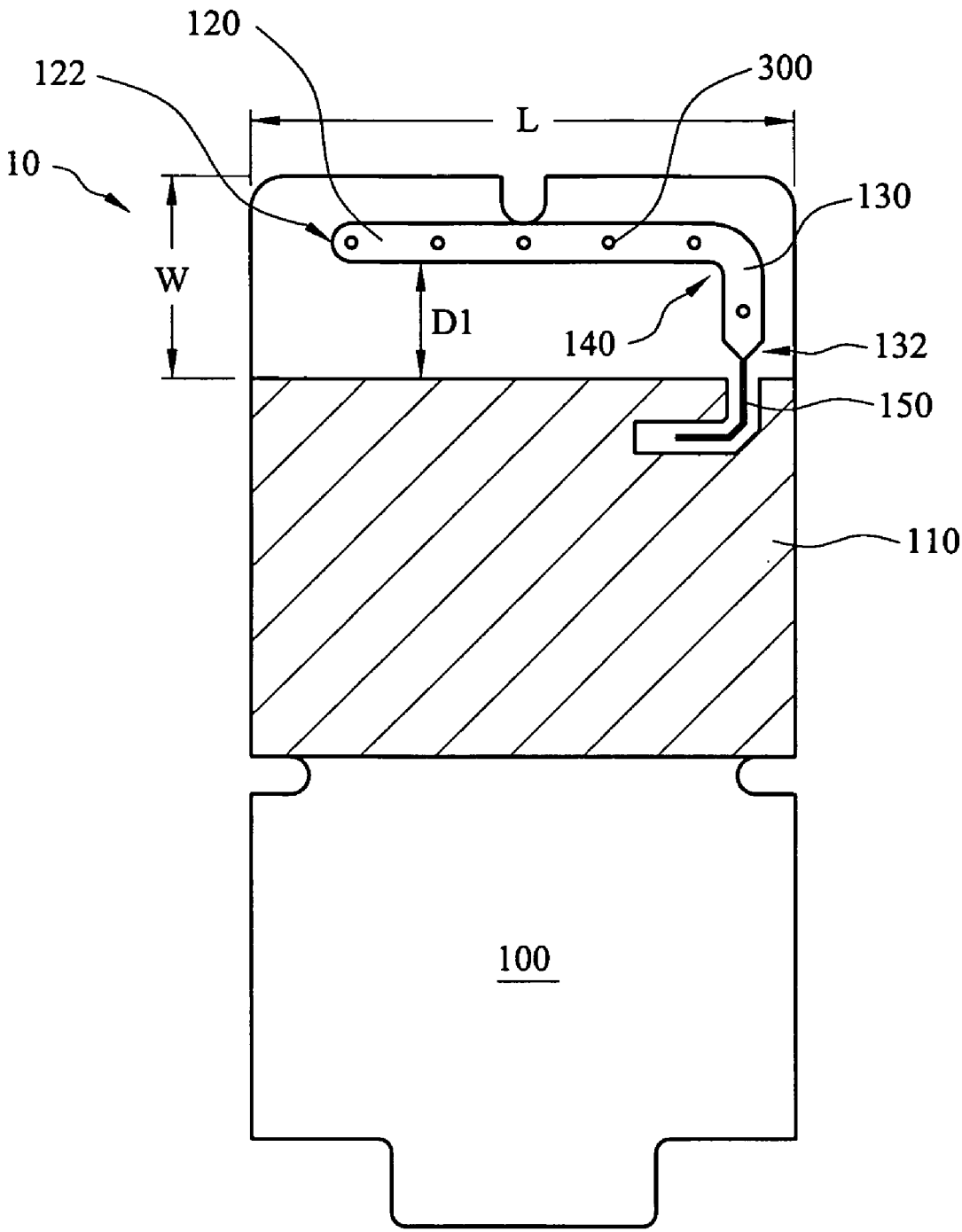
FIG. 2A is a schematic top view of a monopole antenna, according to a second preferred embodiment of the present invention.
Figure 2B:
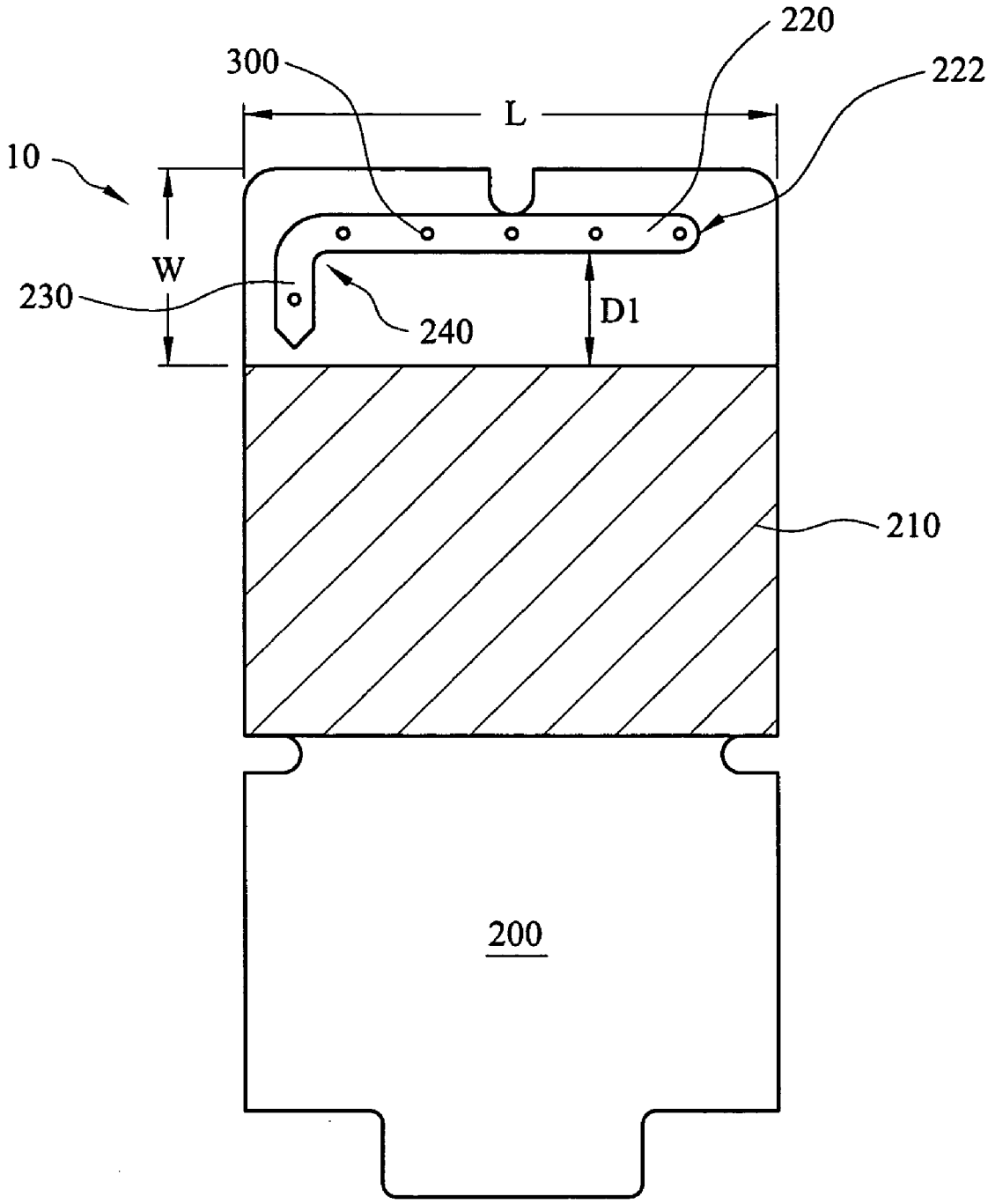
FIG. 2B is a schematic bottom view of the monopole antenna, according to the second preferred embodiment of the present invention.

Referring to FIGS. 2A and 2B, FIG. 2A and FIG. 2B are schematic top and views showing a monopole antenna according to a second preferred embodiment of the present invention. For increasing the antenna gain, a plurality of through holes 300 penetrating the base board 10 from the first substantially L-shaped conductor to the second substantially L-shaped conductor are formed and evenly distributed on the radiating strips.

The design of the monopole antenna of the present invention is based on the design rule of ¼λ (wavelength) antenna. For being operated at about 2.4–2.5 GHz, the length L of the area of the monopole antenna to be implemented is 860 mil, and the width W thereof is 280 mil, i.e. 860 mil×280 mil; the total length of the first (second) substantially L-shaped conductor is about 782 mil, wherein the length of the first (second) extension radiating strip 130 (230) is dependent from the size of the base board 10, and can be such as about ¼–½ of the length of the first main radiating strip 120 (220); the width of the first (second) substantially L-shaped conductor is about 80 mil; and the predetermined distance D1 is adjusted to tune the capacitance effect, and can be such as about 155 mil. As to the ground planes 110 and 210, they also can be the same conductive plane existing in the base board 10. Therefore, the size of the monopole antenna of the present invention is quite small, and can meet the requirements of smallness, thinness, shortness and lightness.

It is noted that the predetermined distance D1 and the through holes 300 are properly adjusted and implemented to increase the bandwidth of the monopole antenna so as to be applicable to IEEE802.11b/g specifications. The locations, sizes and materials of each of the components mentioned above in the first and second preferred embodiments are merely stated for explanation, so that the present invention is not limited thereto.

From the test results, the monopole antenna of the present invention is proved to have excellent antenna features, and can fully cover the bandwidths required by IEEE802.11b/g specifications at about 2.4–2.5 GHz.

Figure 3:
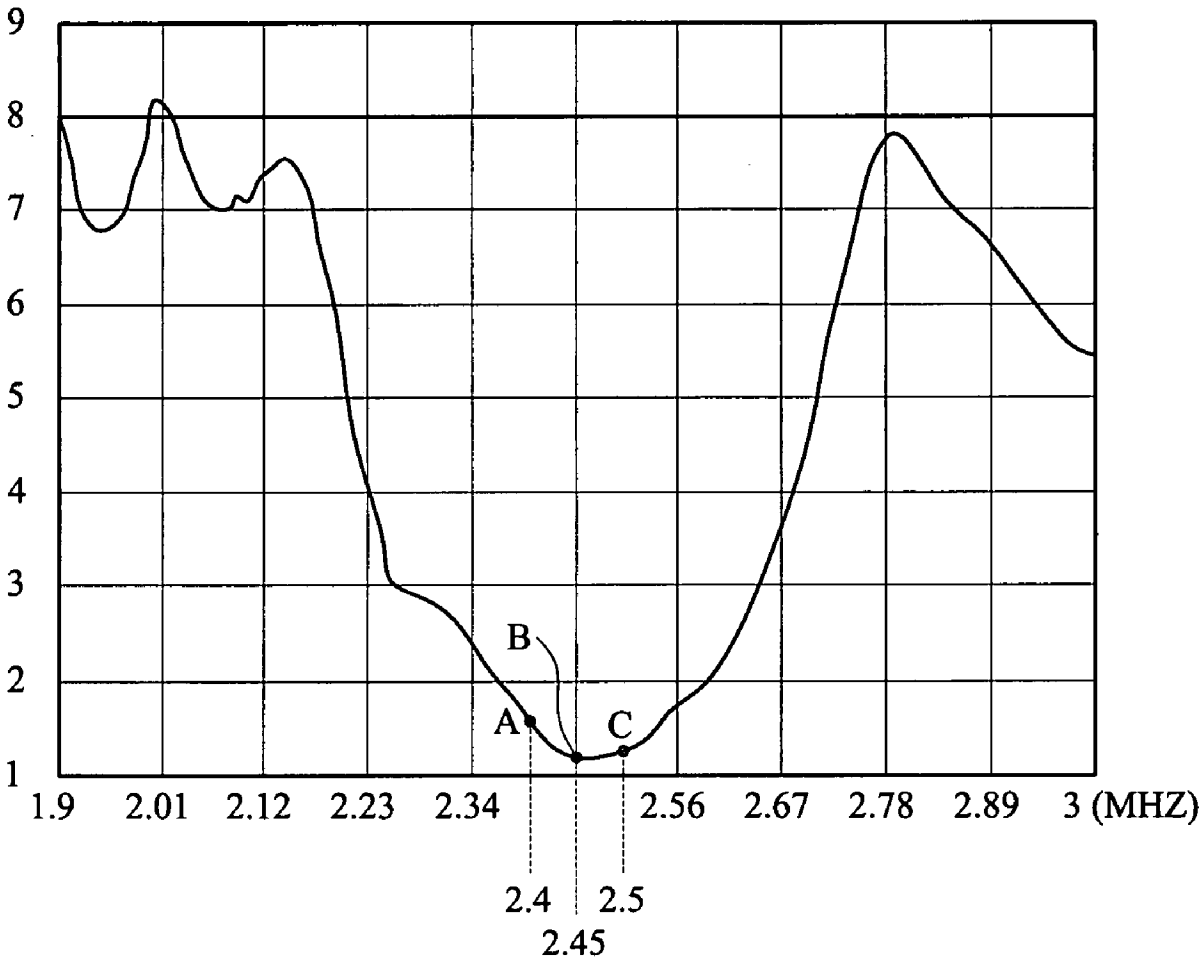
FIG. 3 is a diagram showing a simulation curve of VSWR (Voltage Standing Wave Ratio) vs. frequency for the monopole antenna according to the second preferred embodiment of the present invention.

Referring to FIG. 3, FIG. 3 is a diagram showing a simulation curve of VSWR (Voltage Standing Wave Ratio) vs. frequency for the monopole antenna according to the second preferred embodiment of the present invention. When the monopole antenna of the second preferred embodiment is operated at point A (2.4 GHz), the SWR is about 1:1.6; when at point B (2.45 GHz), the VSWR is about 1:1.71; when at point C (2.5 GHz), the VSWR is about 1:1.28. Therefore, the VSWRs for the monopole antenna operated at 2.4 GHz, 2.45 GHz and 2.5 GHz are all quite low, and thus the bandwidth of the monopole antenna operated at the central frequency of 2.45 GHz is more than 100 MHz.

Figure 4A:
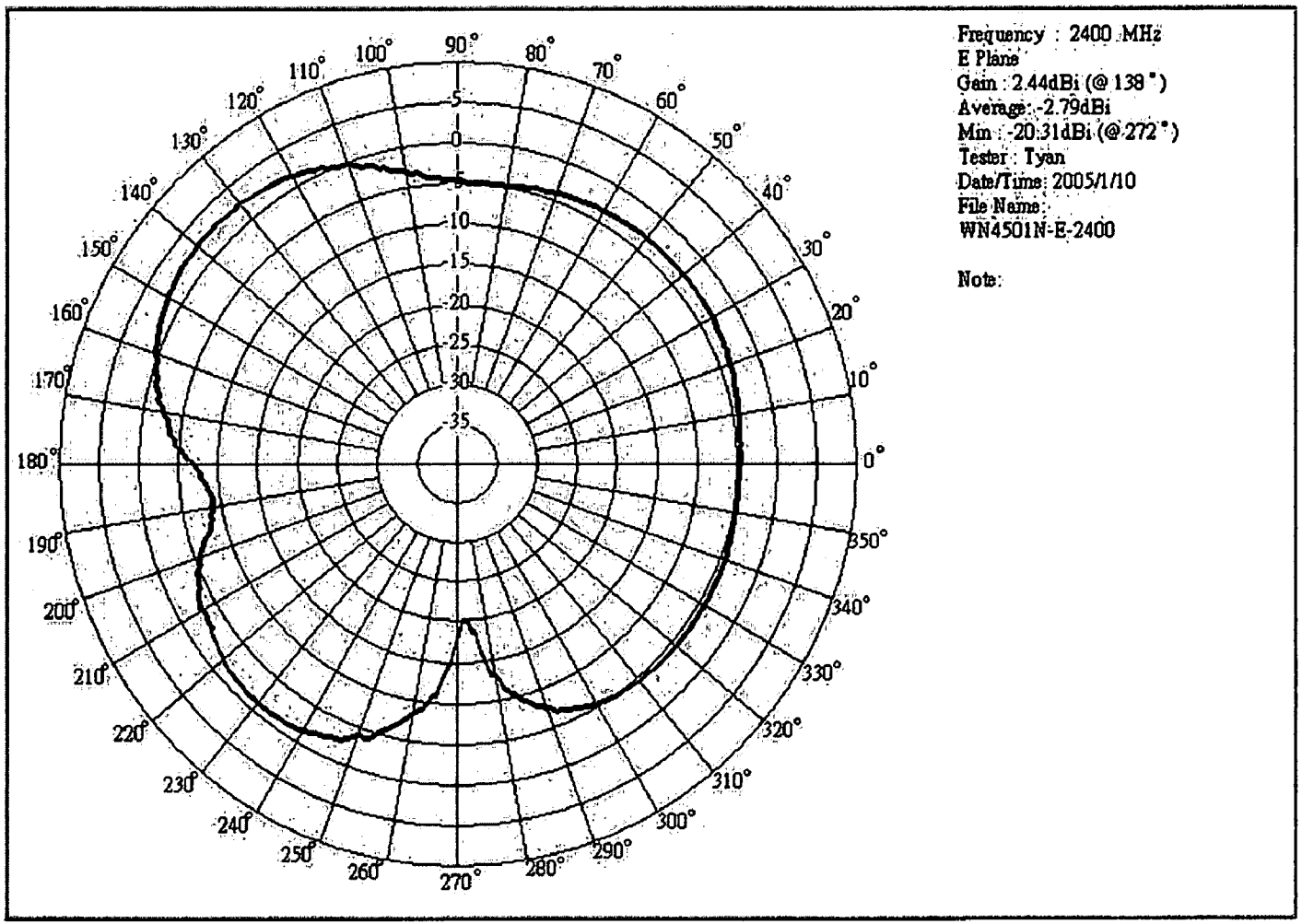
FIG. 4A is a diagram showing a radiation pattern in E plane when the monopole antenna of the second preferred embodiment is operated at 2.4 GHz.
Figure 4B:
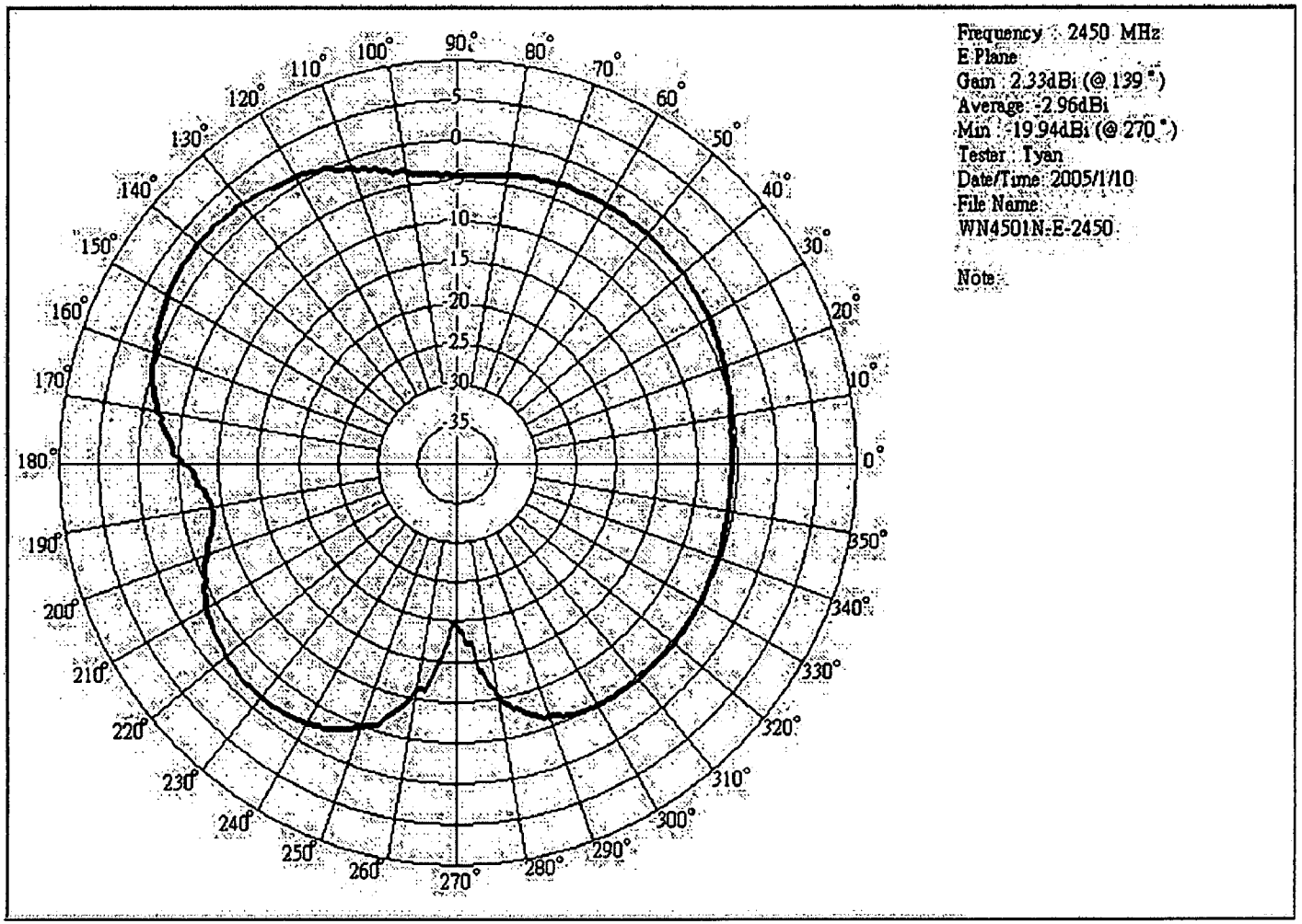
FIG. 4B is a diagram showing a radiation pattern in E plane when the monopole antenna of the second preferred embodiment is operated at 2.45 GHz.
Figure 4C:
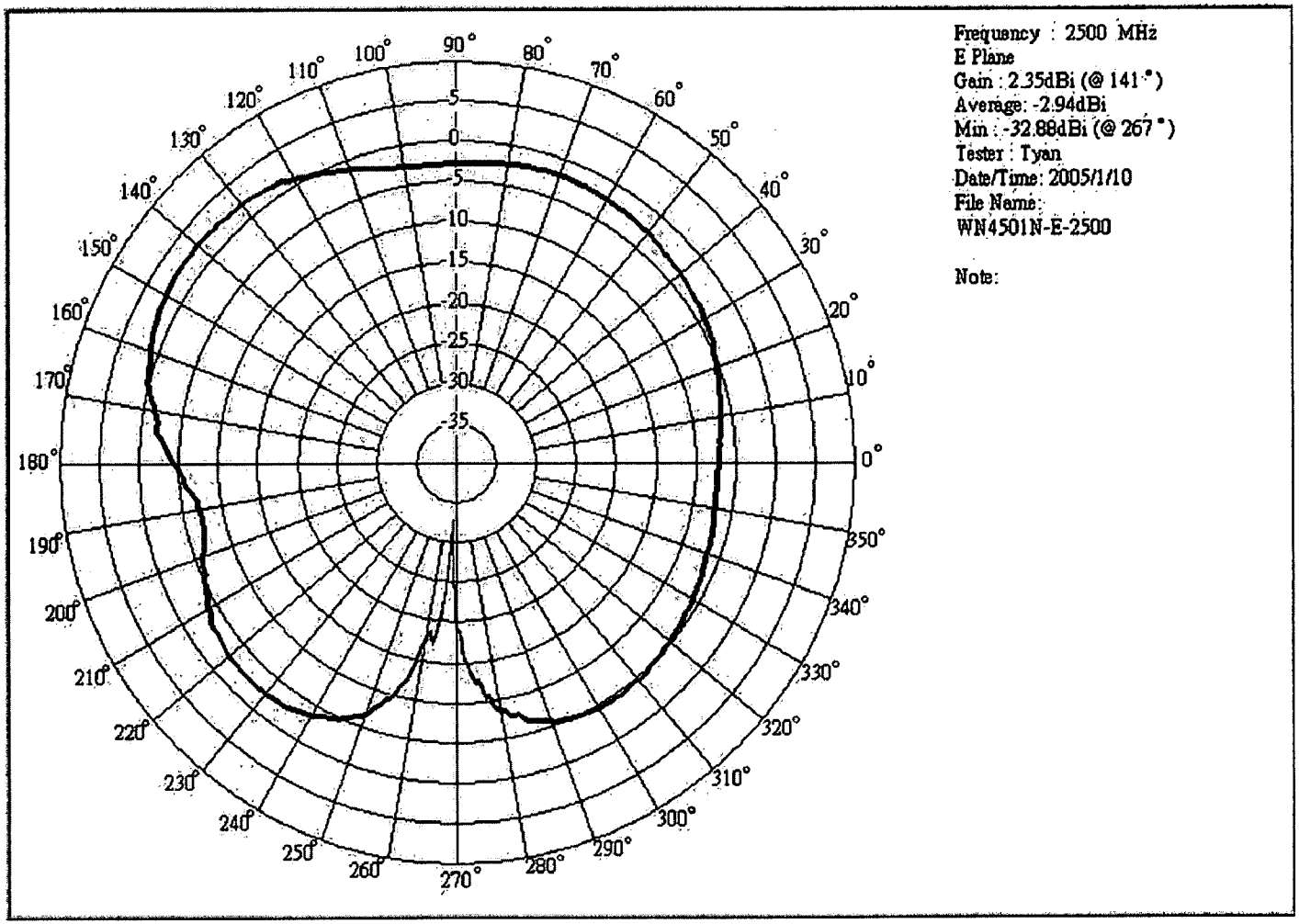
FIG. 4C is a diagram showing a radiation pattern in E plane when the monopole antenna of the second preferred embodiment is operated at 2.5 GHz.

Referring FIG. 4A to FIG. 4C, FIG. 4A to FIG. 4C are diagrams showing radiation patterns in E plane when the monopole antenna of the second preferred embodiment is operated at 2.4 GHz, 2.45 GHz and 2.5 GHZ respectively. Accordingly, it can be known from FIG. 4A to FIG. 4C that the monopole antenna of the second preferred embodiment demonstrates excellent radiation patterns at 2.4 GHz, 2.45 GHz and 2.5 GHz, thus sufficiently satisfying user requirements.

Just as described in the aforementioned preferred embodiments of the present invention, the monopole antenna of the present invention has the advantages of simple structure, low cost, small size, high antenna gain, broad operation bandwidth and good radiation patterns.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A monopole antenna, comprising:

a base board having a first planar surface and a second planar surface opposite to said first planar surface;

a first substantially L-shaped conductor formed on said first planar surface, wherein said first substantially L-shaped conductor is composed of a first main radiating strip and a first extension radiating strip connecting to said first main radiating strip;

a first ground plane formed on said first planar surface, wherein said first main radiating strip and said first ground plane are parallel to and spaced from each other by a predetermined distance;

a second substantially L-shaped conductor formed on said second planar surface, wherein said second substantially L-shaped conductor is composed of a second main radiating strip and a second extension radiating strip connecting to said second main radiating strip; and a second ground plane formed on said second planar surface, wherein said second main radiating strip and said second ground plane are parallel to and spaced from each other by said predetermined distance.

2. The monopole antenna of claim 1, wherein said second substantially L-shaped conductor is mirror-reflected to said first substantially L-shaped conductor.

3. The monopole antenna of claim 1, having a plurality of through holes penetrating said base board from said first substantially L-shaped conductor to said second substantially L-shaped conductor, wherein said through holes are evenly distributed on said first substantially L-shaped conductor and said second substantially L-shaped conductor.

4. The monopole antenna of claim 1, wherein a first rounded angle is formed between said first main radiating strip and said first extension radiating strip, and a second rounded angle is formed between said second main radiating strip and said second extension radiating strip.

5. The monopole antenna of claim 1, wherein a feeding strip is electrically connected to the open end of said first extension radiating strip.

6. The monopole antenna of claim 5, wherein the open end of said first extension radiating strip is formed in a V shape.

7. The monopole antenna of claim 1, wherein the open end of said first main radiating strip is rounded.

8. The monopole antenna of claim 1, wherein the length of said first extension radiating strip is substantially ¼–½ of the length of said first main radiating strip.

9. The monopole antenna of claim 1, wherein the length of said second extension radiating strip is substantially ¼–½ of the length of said second main radiating strip.

10. The monopole antenna of claim 1, wherein said first ground plane and said second ground plane are the same conductive plane existing in said base board.

11. The monopole antenna of claim 1, wherein said first ground plane is formed on said first planar surface, and said second ground plane is formed on said second planar surface.

12. The monopole antenna of claim 1, wherein said base board is a printed circuit board (PCB).

13. The monopole antenna of claim 1, further having:

a plurality of through holes penetrating said base board, wherein said through holes are evenly distributed on said first substantially L-shaped conductor and said second substantially L-shaped conductor.

14. A monopole antenna, comprising:

a base board having a first planar surface and a second planar surface opposite to said first planar surface;

a first substantially L-shaped conductor formed on said first planar surface, wherein said first substantially L-shaped conductor is composed of a first main radiating strip and a first extension radiating strip connecting to said first main radiating strip, and a first rounded angle is formed between said first main radiating strip and said first extension radiating strip;

a first ground plane formed on said first planar surface, wherein said first main radiating strip and said first ground plane are parallel to and spaced from each other by a predetermined distance;

a second substantially L-shaped conductor formed on said second planar surface, wherein said second substantially L-shaped conductor is composed of a second main radiating strip and a second extension radiating strip connecting to said second main radiating strip, and a second rounded angle is formed between said second main radiating strip and said second extension radiating strip;

a second ground plane formed on said second planar surface, wherein said second main radiating strip and said second ground plane are parallel to and spaced from each other by said predetermined distance; and a feeding strip is electrically connected to the open end of said first extension radiating strip;

wherein a plurality of through holes penetrating said base board are evenly distributed on said first substantially L-shaped conductor and said second substantially L-shaped conductor.

15. The monopole antenna of claim 14, wherein said second substantially L-shaped conductor is mirror-reflected to said first substantially L-shaped conductor.

16. The monopole antenna of claim 14, wherein the length of said first extension radiating strip is substantially ¼–½ of the length of said first main radiating strip.

17. The monopole antenna of claim 14, wherein the length of said second extension radiating strip is substantially ¼–½ of the length of said second main radiating strip.

18. The monopole antenna of claim 14, further having:

a plurality of through holes penetrating said base board, wherein said through holes are evenly distributed on said first substantially L-shaped conductor and said second substantially L-shaped conductor.

19. The monopole antenna of claim 14, wherein the open end of said first extension radiating strip is formed in a V shape.

20. The monopole antenna of claim 14, wherein the open end of said first main radiating strip is rounded.

* * * * *